US006210199B1

(12) United States Patent
Walkup et al.

(10) Patent No.: US 6,210,199 B1
(45) Date of Patent: Apr. 3, 2001

(54) LOCKING MECHANISM FOR A CAM LEVER USED IN A PIN GRID ARRAY SOCKET

(75) Inventors: William B. Walkup, Hillsboro, OR (US); Ming Lun Szu, Taipei (TW)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 09/449,197

(22) Filed: Nov. 24, 1999

(51) Int. Cl.[7] ..... H01R 11/22
(52) U.S. Cl. ..... 439/342; 439/266
(58) Field of Search ..... 439/342, 259–270

(56) References Cited

U.S. PATENT DOCUMENTS 5,443,591 * 8/1995 Tsai ..... 439/342
5,489,218 * 2/1996 McHugh ..... 439/342
5,679,020 * 10/1997 Lai et al. ..... 439/342
5,692,920 * 12/1997 Banakis et al. ..... 439/342
6,017,234 * 1/2000 Walkup ..... 439/342

* cited by examiner

*Primary Examiner*—Gary F. Paumen
(74) *Attorney, Agent, or Firm*—Wei Te Chung

(57) ABSTRACT

A locking mechanism is used in a pin grid array socket which comprises a movably housing and a stationary housing. The locking mechanism comprises a cam lever having a handle bar connected to a cam which is pivotally connected to the stationary housing and operative to drive the movable housing to move in opposite directions. An elongated channel is defined along the handle bar. A first reception groove is formed in the movable housing. A latch is movably and rotatably received in the elongated channel. A head of the latch is movably inserted into the first reception groove for locking the cam lever and preventing the movable housing from movement.

1 Claim, 6 Drawing Sheets

LOCKING MECHANISM FOR A CAM LEVER USED IN A PIN GRID ARRAY SOCKET

BACKGROUND OF THE INVENTION

1. Field of The Invention

The present invention relates to a locking mechanism for a cam lever used in a pin grid array socket, especially a locking mechanism for retaining the cam lever in a tightened status and preventing the latter from leaving the status due to tension existed in the contacts of the pin grid array socket.

2. The Prior Art

Conventional pin grid array sockets normally comprise a cover defining a plurality of upper passageways therein and slidably engaging with a base which defines a corresponding number of lower passageways retaining contact therein. The upper passageways and the lower passageways are in constant communication with each other. A cam is received in a space defined between the cover and the base and operative to move the cover along the base thereby positioning the socket at either a loosened status ready for insertion of pins of the CPU or a tightened status forcing the pins of the CPU to abut against the corresponding contacts. When the socket is in the loosened status, the pins of the CPU are inserted into the upper passageways and the lower passageways with a substantially zero insertion force (ZIF), but are not in electrical contact with the contacts retained in the lower passageways. The cam is then operated to drive the cover to move laterally along the base thereby urging the pins of the CPU module to electrically connect with the contact of the base. The CPU module is moved by the cover of the socket when the socket is changed from the loosened status to the tightened status.

The CPU module is commonly engaged with a heat sink for heat dissipation. However, due to the high density of modularization, the CPU module is heavy and has a large dimension. Thus, the addition of the heat sink causes the assembly of the CPU module and the heat sink to be larger and heavier which in turn causes difficulty for the cam to drive the cover on which the CPU module and the heat sink are seated.

To solve the problem, U.S. Pat. No. 6,017,234, which is enclosed herein for reference and which are invented by the same inventors of the present application, discloses a two-layer ZIF PGA socket comprising a mother housing having a first recess and a hole defined in an edge of the first recess, a beam exposing to the hole and the first recess and a pivot extending from the beam. Two daughter housings are slidably received in the first recess of the mother housing and each daughter housing comprises a C-shaped head portion extending out the mother housing and defining a second recess for loosely receiving the beam of the mother housing. The C-shaped head portions of the daughter housings are matingly configured to define a first reception space therebetween and together are movable along a same direction. A cam lever comprises a cam and a handle bar connected to the cam. The cam is rotatably received in the first reception space between the daughter housings and defines a hole for rotatably receiving the pivot of the mother housing. A first block and a second block extend from the cam and both are spaced away by the hole of the cam and the beam of the mother housing for respectively driving the configured daughter housings to move in opposite directions when the handle bar is manually operated in different directions.

Although U.S. Pat. No. 6,017,234 can solve the problems encountered in the prior art, it has a minor problem to be solved, that is the retention of the cam lever in the tightened status may not strong enough to retain its status because the tension of the contacts may force the daughter housings to move backward and leave its tightened status.

It is requisite to provide a locking mechanism configured with the cam lever for retaining the cam lever in the tightened status and preventing the latter from leaving this status due to tension existed in the contacts of the pin grid array socket.

SUMMARY OF THE INVENTION

The primary purpose of the present invention is to provide a locking mechanism configured with a cam lever which is used to drive a ZIF pin grid array socket between a loosened status and a tightened status.

Another purpose of the present invention is to provide a socket having a locking mechanism for locking the socket in a specific status.

In accordance with one aspect of the present invention, a locking mechanism is provided in a socket which comprises a movably housing and a stationary housing. The locking mechanism comprises a cam lever having a handle bar connected to a cam which is pivotally connected to the stationary housing and operative to drive the movable housing to move in opposite directions. An elongated channel is defined along the handle bar. A first reception member is formed in the movable housing. A latch is movably and rotatably received in the elongated channel. A head of the latch is movably engaged with the first reception member for locking the cam lever and preventing the movable housing from movement.

In accordance with another aspect of the present invention, a socket comprises a daughter housing unit movably received in a mother housing, a cam lever having a handle bar connected to a cam which is pivotally connected to the mother housing and operative to drive the daughter housing unit to move in opposite directions. An elongated channel is defined along the handle bar. A first reception member is formed in the daughter housing unit. A latch is movably and rotatably received in the elongated channel. The latch is movably engaged with the first reception member for locking the cam lever and preventing the daughter housing unit from movement.

DETAILED DESCRIPTION OF THE PREFERRED EMBODIMENT

Figure 1:
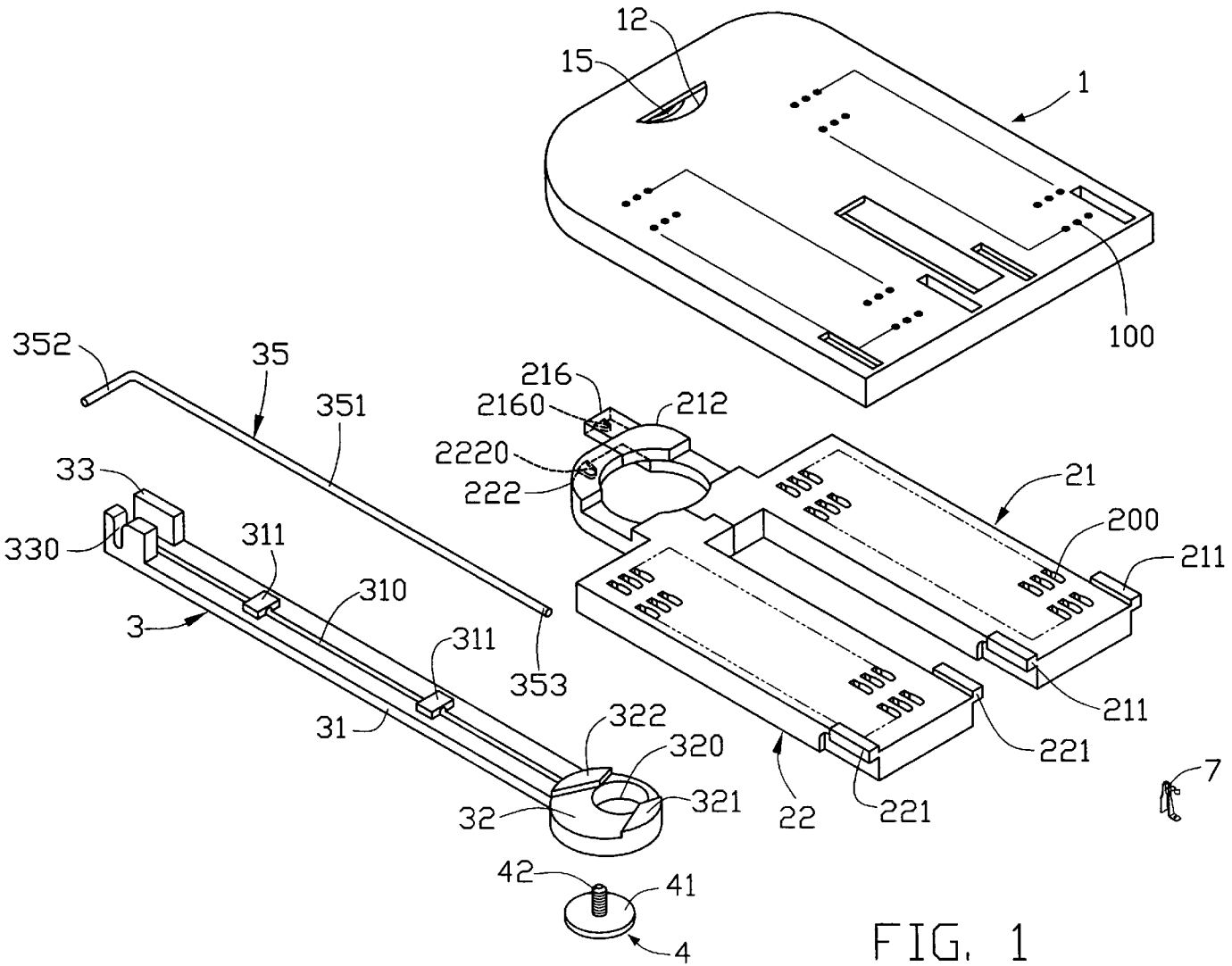
FIG. 1 is an exploded view of a ZIF pin grid array socket in accordance with the present invention.

Referring to FIG. 1, a ZIF PGA socket in accordance with the present invention comprises a mother housing 1 defining a plurality of first passageways 100 for receiving pins of a CPU module (not shown), a first and a second daughter housings 21, 22 slidably received in the mother housing 1 and each defining a plurality of second passageways 200 each of which aligns with the corresponding first passageway 100 and receives a contact 7 therein. The mother housing 1 has a pivot 15 formed near one edge thereof and a semicircular slot 12 defined near the edge proximate to the pivot 15. The first and second housings 21, 22 each have two engagement tabs 211, 221 extending from two parallel sides thereof, a head 212, 222 extending from a corner thereof.

Figure 2:
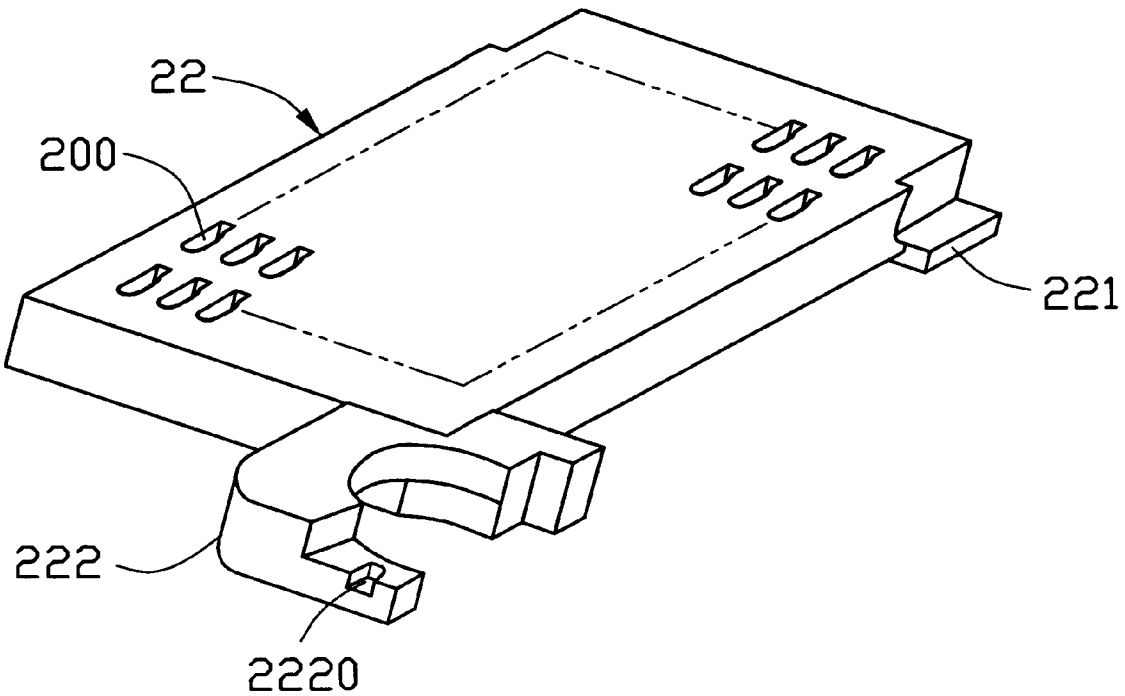
FIG. 2 is a perspective view of a daughter housing of FIG. 1 for particularly illustrating a reception groove thereof.

The assembling between the mother housing 1 and the daughter housings 21, 22 and the function thereof have been detailed in U.S. Pat. No. 6,017,234 which is enclosed herein. Differently, a flange 216 extends from the head 212 of the first daughter housing 21 and defines a first reception groove 2160 at a bottom surface thereof. Also referring to FIG. 2, a second reception groove 2220 is defined at a bottom surface of the head 222 of the second daughter housing 22 and spaced away from the first reception groove 2160 with a predetermined distance. Both the first reception groove 2160 and the second reception groove 2220 are converged from an outer portion thereof to an inner portion thereof.

Figure 3:
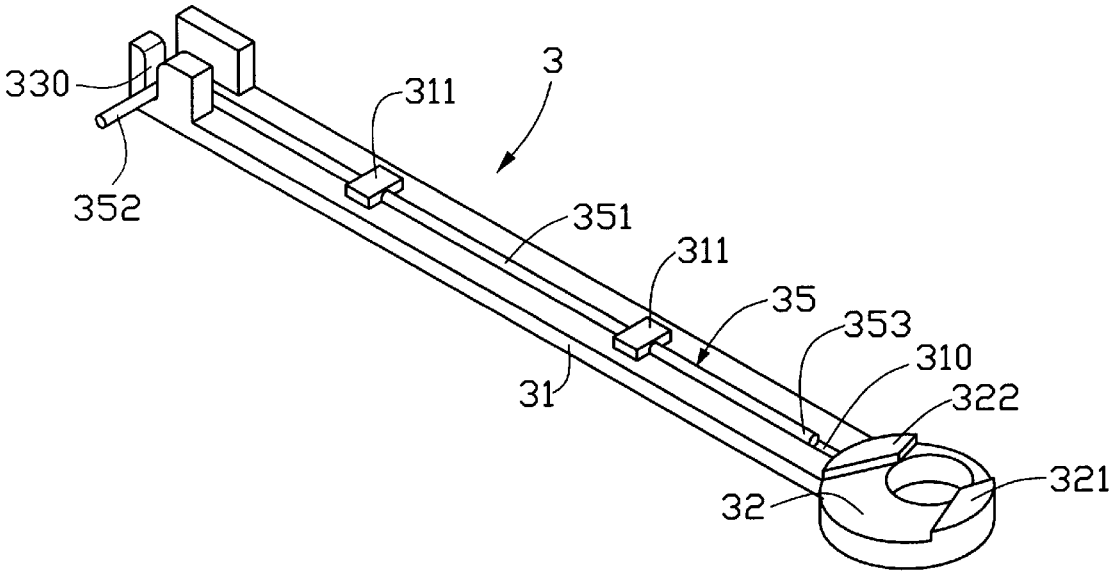
FIG. 3 is an assembly view of the cam lever and the locking member of FIG. 1.

A cam lever 3 similar to that disclosed in U.S. Pat. No. 6,017,234 comprises a handle bar 31 connected to a cam 32 which defines a hole 320 adapted to rotatably receive the pivot 15 of the mother housing 1 and comprises a first block 321 and a second block 322 spaced by the hole 320 for respectively driving the daughter housings 21, 22 to move in opposite directions when the cam lever 3 is pivotally rotated in opposite directions with respect to the pivot 15. Two protrusions 33 extend from one end of the handle bar 31 for facilitating manual operation. Different to that disclosed in U.S. patent application Ser. No. 09/256,639, a positioning cutout 330 is defined in one of the protrusions 33. An elongated channel 310 is defined along the handle bar 31 and a portion of the elongated channel 310 is located between the two protrusions 33. Two covers 311 are formed on the handle bar 31 and passed by the elongated channel 310. An L-shaped latch 35 includes an elongated section 351 having a head 353 and a lateral section 352 bent from the elongated section 351. The elongated section 351 of the L-shaped latch 35 is movably and rotatably received in the elongated channel 310 as shown in FIG. 3.

A stud 4 identical to that disclosed in U.S. Pat. No. 6,017,234 has a circular cap portion 41 having a diameter greater than the diameter of the hole 320 of the cam 32 and a threaded rod portion 42 extending from a center of the circular cap portion 41 and threaded into the pivot 15 of the mother housing 1 for pivotably fixing the cam 32 to the pivot 15.

Figure 4:
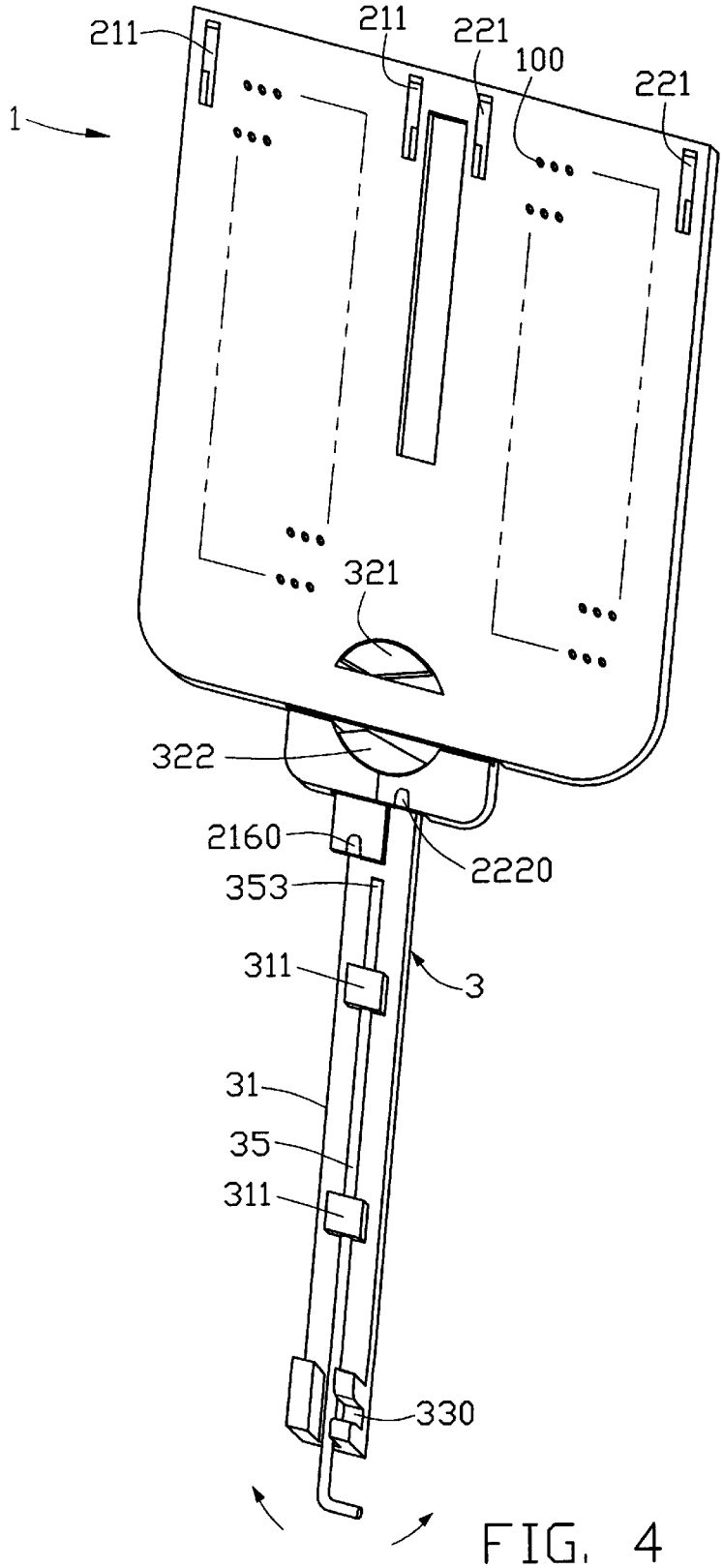
FIG. 4 is an assembly view of FIG. 1.

The ZIF PGA socket may be assembled as shown in FIG. 4, where the L-shaped latch 35 is movably retained in the elongated channel 310 and the lateral section 352 thereof extends beyond the protrusions 33 of the cam lever 3 for at least a distance to ensure that the head 353 of the L-shaped latch 35 not be blocked by the flange 216 when the cam lever 3 is pivotally moved with respect to the pivot 15. The covers 311 may be used to further limit the elongated section 351 of the L-shaped latch 35 in the elongated channel 310.

Figure 5:
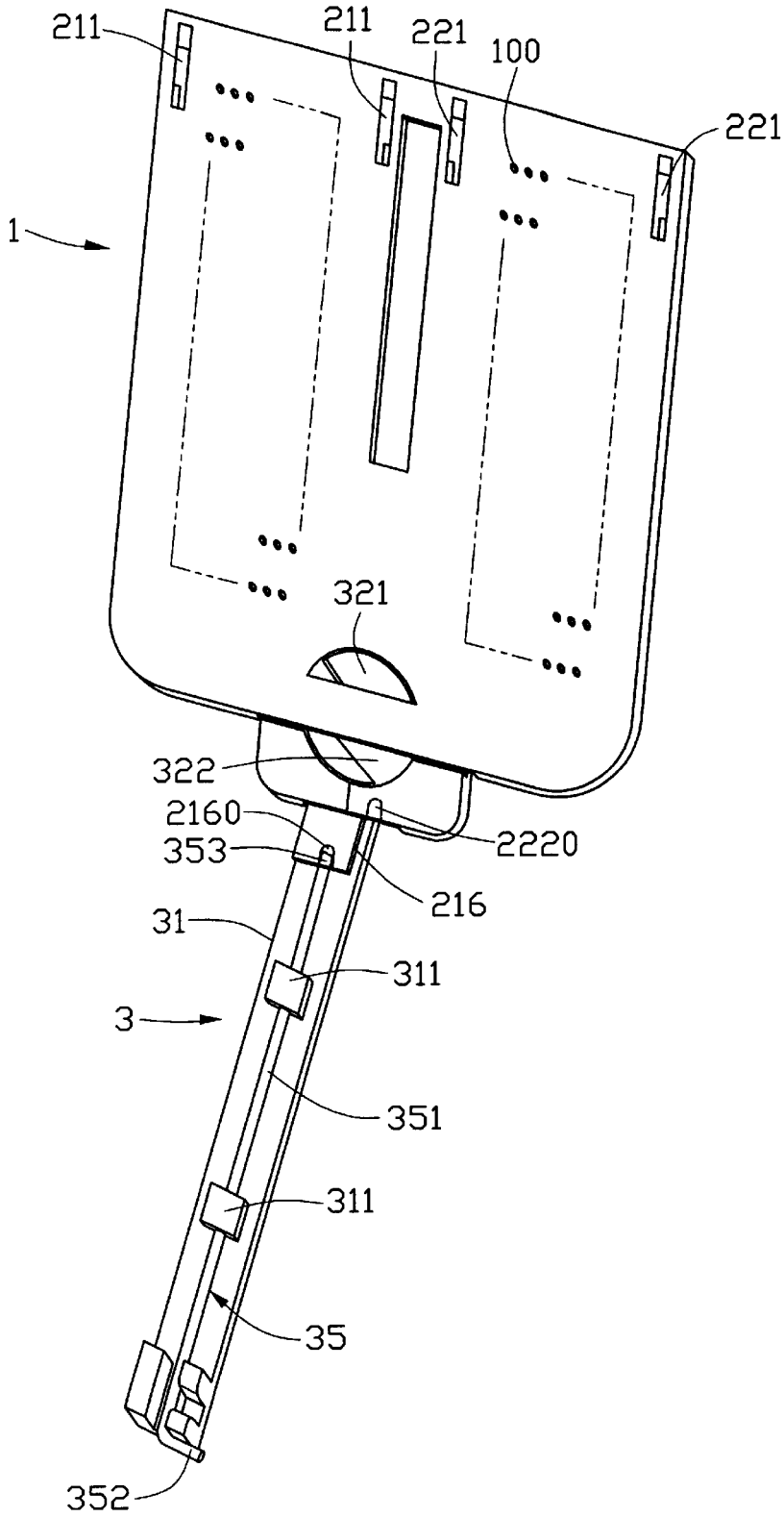
FIG. 5 is a perspective view showing that the pin grid array socket is locked in a loosened status.
Figure 6:
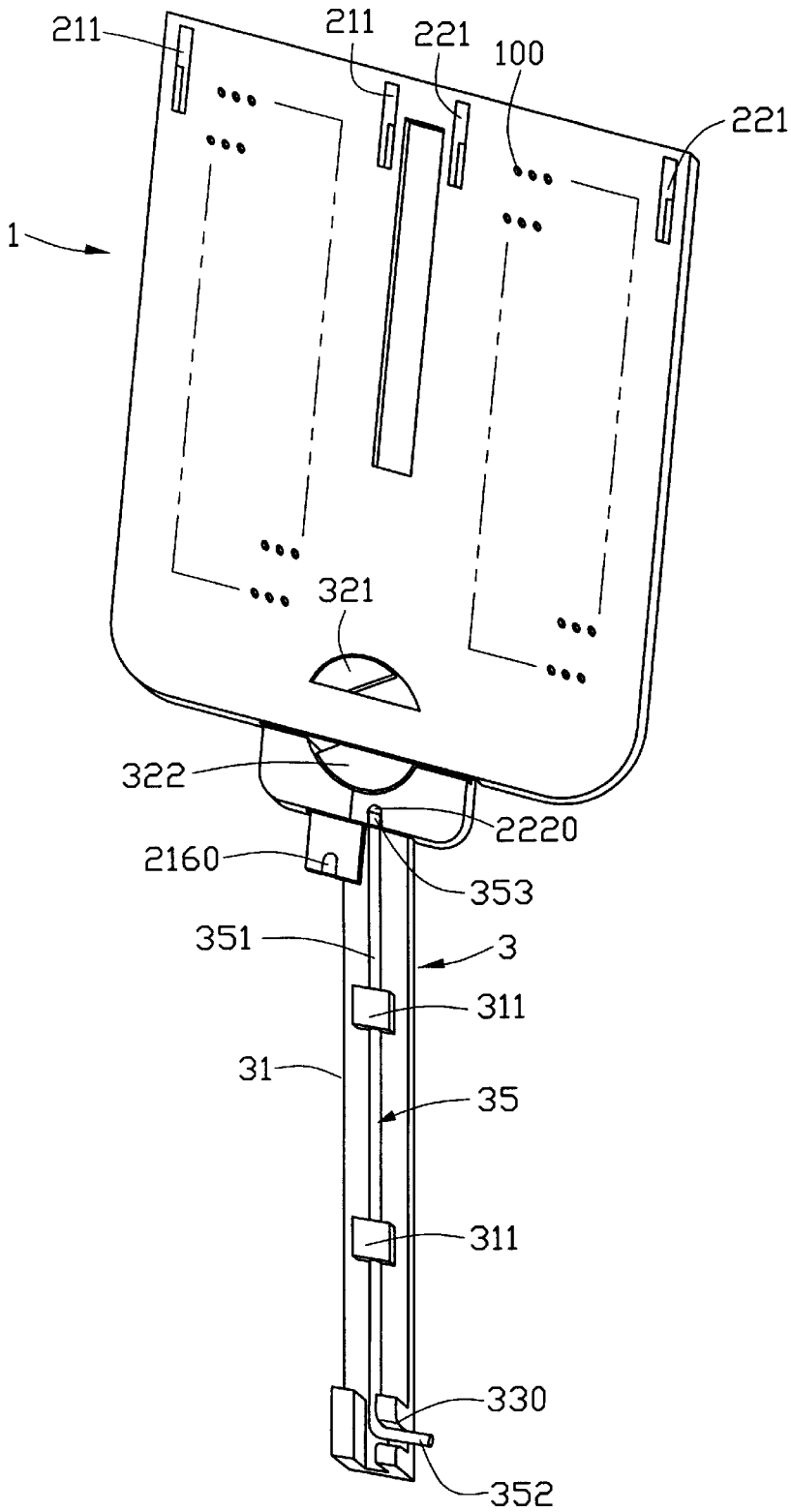
FIG. 6 is a perspective view showing that the pin grid array socket is locked in a tightened status.

Normally, the socket is operative to be in a loosened status ready for receiving CPU pins with zero insertion force. In the loosened status, the head 353 of the L-shaped latch 35 is retained in the first reception groove 2160 of the flange 216, the lateral section 352 is located adjacent to the protrusions 33 of the cam lever 3, and the cam lever 3 is locked in a first orientation with respect to the pivot 15 of the mother housing 1, as shown in FIG. 5. After CPU pins are inserted into the socket, the socket may be further operated to change from the loosened status to a tightened status by pulling the L-shaped latch 35 to release it from the retention of the first reception groove 2160, pivotally moving the cam lever 3 to a rightmost position, pushing the head 353 of the L-shaped latch 35 into the second reception groove 2220, and rotate the lateral section 352 of the L-shaped latch 35 to retain it in the positioning cutout 330 as shown in FIG. 6. The cam lever 3 is locked in a second orientation with respect to the pivot 15 of the mother housing 1 during the tightened status. The lateral section 352 of the L-shaped latch 35 facilitates a user to rotate and move the L-shaped latch 35 in the elongated channel 310 for locking/releasing the latch 35 on/from the daughter housings 21, 22.

In conclusion, the L-shaped latch 35, the cam lever 3, and the reception grooves 2160, 2220 constitute a locking mechanism preventing the socket from leaving its loosened or tightened status.

While the present invention has been described with reference to a specific embodiment, the description is illustrative of the invention and is not to be construed as limiting the invention. Therefore, various modifications to the present invention can be made to the preferred embodiment by those skilled in the art without departing from the true spirit and scope of the invention as defined by the appended claims.

What is claimed is:

1. A socket comprising:

a daughter housing unit movably received in a mother housing;

a cam lever having a handle bar connected to a cam which is pivotally connected to the mother housing and operative to drive the daughter housing unit to move in opposite directions;

an elongated channel defined along the handle bar;

a first reception member formed in the daughter housing unit;

a latch movably and rotatably received in the elongated channel;

wherein the latch is movably engaged with the first reception member for locking the cam lever and preventing the daughter housing unit from movement;

further comprising a second reception member formed in the daughter housing unit and spaced away from the first reception member with a predetermined distance for retaining the head of the latch and locking the cam lever in a different orientation with respect to the orientation in which the first reception member locks the cam lever;

further comprising at least a cover formed on the elongated channel and passed by the elongated channel for limiting the latch in the elongated channel;

wherein the first reception member is formed in a flange extending from the daughter housing unit;

wherein the latch has an elongated section and a lateral section connected to the elongated section and the head of the latch is formed at one end of the elongated section opposite the lateral section;

wherein at least one protrusion is formed at one end of the cam lever adjacent to the elongated channel for facilitating manual operation;

wherein the at least one protrusion has a cutout formed therein for retaining the lateral section of the latch;

wherein the daughter housing, unit comprises two halves configured with each other;

wherein the first reception member is a groove;

wherein the second reception member is a groove.

* * * * *